US005224530A

United States Patent [19]

Wolf

[11] Patent Number: 5,224,530

[45] Date of Patent: Jul. 6, 1993

[54] CLAMPING AND FEEDING DEVICE FOR THE MACHINING OF BOLES

[75] Inventor: Johann Wolf, Scharnstein, Austria

[73] Assignee: Wolf Systembau Gesellschaft mbH, Scharnstein, Austria

[21] Appl. No.: 887,400

[22] Filed: May 21, 1992

[30] Foreign Application Priority Data

May 21, 1991 [AT] Austria ..... A1036/91

[51] Int. Cl.[5] ..... B27C 9/00; B27B 31/00

[52] U.S. Cl. ..... 144/242 R; 83/708; 144/3 R; 144/242 A; 144/39; 144/369; 144/377

[58] Field of Search ..... 144/242 R, 242 B, 242 E, 144/242 A, 245 R, 3 R, 39, 357, 369, 370, 376, 377; 83/708, 710, 711; 269/308

[56] References Cited

U.S. PATENT DOCUMENTS 4,147,259 4/1979 Nilsson ..... 144/242 R
4,294,149 10/1981 Olsson ..... 144/242 R
4,772,001 9/1988 Hurdle, Jr. ..... 269/308

FOREIGN PATENT DOCUMENTS 0195423 9/1986 European Pat. Off. .

*Primary Examiner*—W. Donald Bray
*Attorney, Agent, or Firm*—Young & Thompson

[57] ABSTRACT

The combination with a machining tool for machining boles, of a clamping and feeding device for feeding the boles to the machining tool. The clamping and feeding device comprises a slide on which the bole rests during machining. The slide has mounted thereon a pivotable device that directly supports the bole, this pivotable device being elongated and extending lengthwise of the bole and being pivotally connected at one end to the slide. A power jack changes the elevation of the other end of the elongated pivotal device thereby to permit positioning the bole with its heart zone parallel to the direction of movement of the slide. In another embodiment, a lifting device is carried by the slide for lifting one end of the bole relative to the other end of the bole, the lifting device comprising at least one cam supported eccentrically on the slide, and a power jack to rotate the at least one cam to lift the one end of the bole.

9 Claims, 1 Drawing Sheet

CLAMPING AND FEEDING DEVICE FOR THE MACHINING OF BOLES

Figure 1:
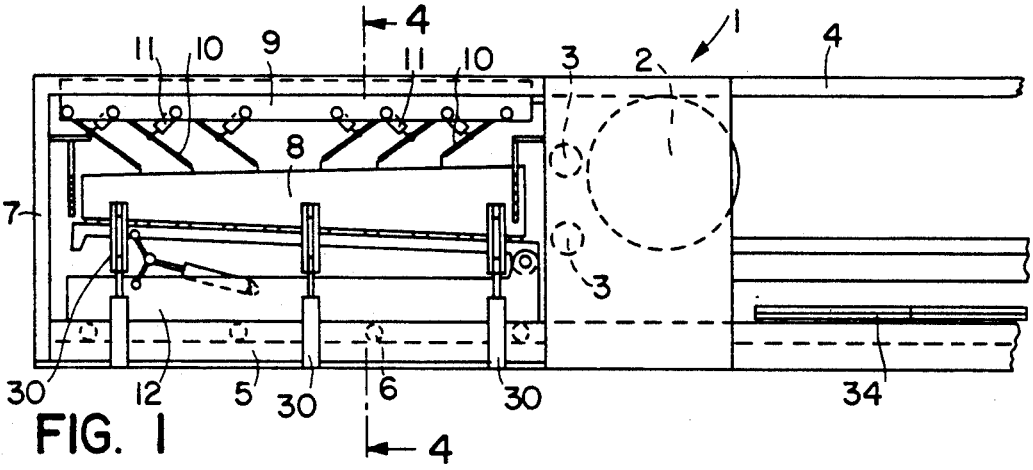

The invention relates to a clamping and feeding device for the machining of boles by means of machining tools, such as band saws or circular saws, milling cutters, and the like, with a slide on which the bole rests during machining.

Conventional machining devices of this type conduct the round timber past the stationary tools by means of a horizontally guided slide on which the round timber is retained with hold-downs and clamping units on the end faces, the timber being cut in correspondence with the positioning of the tools. The hold-downs and the clamping units on the end faces travel in synchronism with the slide in a rail located above the tools. By repeated forward and backward passage of the clamped-in-place bole, the latter is processed into boards and beams, etc. In order to avoid subsequent edging of the boards (which would mean an additional operating step), the boards are trimmed on the grown timber, i.e. two spaced-apart rotary milling cutters mounted in front of the saw cut off the sapwood (rounded portion) on both sides while the bole is passing through so that the subsequently arranged saw separates an edged board from the bole. An asymmetrical edging process occurs in the above-described conventional clamped retention of the bole since the latter lies obliquely on the slide on account of its conicity. The upper sapwood is here cut off to a much broader dimension than the lower one. The thus-manufactured boards, beams, and so forth exhibit an inclined extension of the fibers and the heart. This is not only unpleasant from an optical viewpoint but also reduces the strength of the boards, beams, etc.

It is an object of the invention to provide a device for slide-mounted saws making it possible to guide the round timber through the machining tools in such a way that symmetrical edging of the sapwood is feasible.

This object has been attained by providing that the slide comprises an arrangement for lifting the top end of the tree trunk.

Thereby, the bole can be lifted at its top end to such an extent that the heart zone of the bole coincides with the feeding direction, and the bole is thus machined in symmetrical fashion.

According to a preferred embodiment of the invention, characterized in that the lifting means is a support on which the bole rests, the end of this support associated with the head end of the bole being rotatably supported on the slide and the end of the support associated with the tail end of the bole being preferably connected to the slide by way of an elevating means, the lifting of the tail end of the bole is performed in a very simple way, any sagging of the bole being prevented by the continuously extending bearing of the bole by the support.

In order to provide a maximally continuous rest of the bole on the support and to prevent slippage of the bole on the support, the latter can be equipped with toothed projections on the side on which the bole rests.

According to another preferred embodiment of the invention, the provision can be made that the lifting device is constituted by at least one eccentrically supported, preferably toothed cam on which the bole rests. By rotating the eccentrically supported cam, the tail end of the bole can be hoisted in a very simple manner and without great expenditure of force.

By further providing that the slide has at least two eccentrically mounted cams and, on the end associated with the tail end of the bole, a bearing preferably studded with teeth, and by providing that the regions of the cams and of the bearing on which the bole rests lie on a straight line in any position of the cams, then the bole can likewise be lifted uniformly and without sagging since the bole is supported in its middle zone by at least one additional cam.

Figure 2:
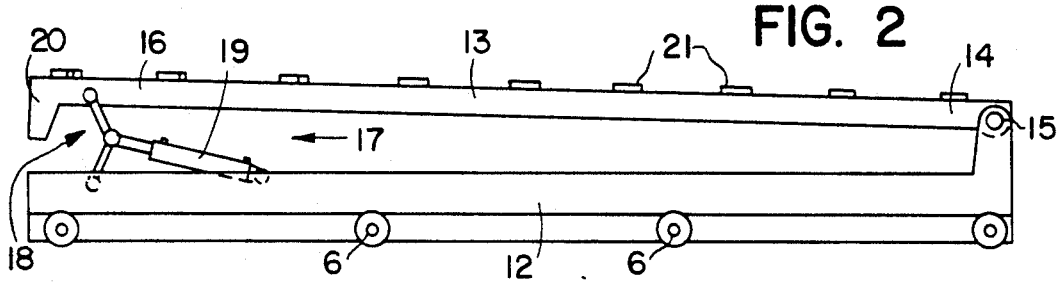
Figure 3:
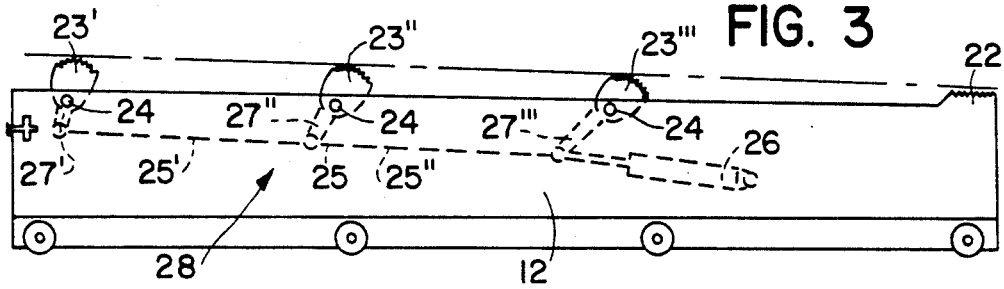
Figure 4:
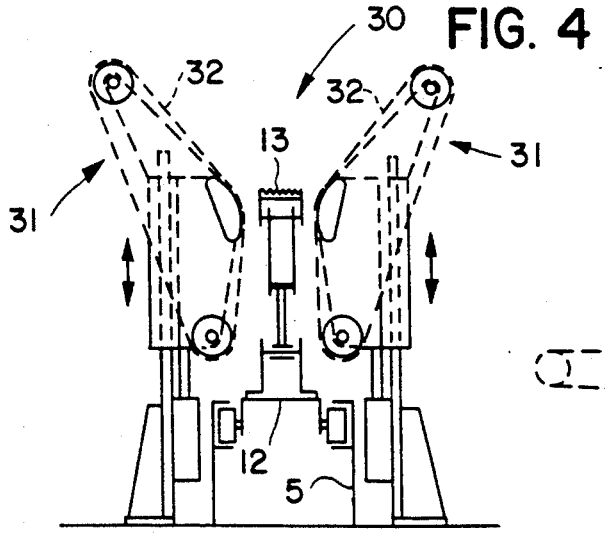
Figure 5:
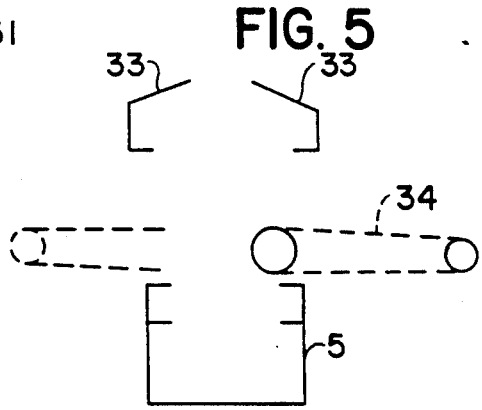

Further features and advantages of the invention can be seen from the dependent claims and the specification with reference to the drawings wherein:

FIG. 1 shows a fragmentary view of a saw with one embodiment of the device according to this invention, FIG. 2 shows an enlarged view of the device according to this invention shown in FIG. 1, FIG. 3 is another embodiment of the device according to the invention, FIG. 4 shows a partial sectional view of the device of FIG. 1 along line IV—IV, and FIG. 5 shows another schematic sectional view of part of the saw.

The saw illustrated in FIG. 1 comprises a machining center 1 accommodating machining tools, such as a circular saw 2 and milling cutters 3 and their drive mechanisms. A profiled beam 4 and a slide guide means 5,which extend in front of and after the machining center 1 by at least the length of the slide 12 on which the bole rests, are arranged centrally above and below the machining center 1. The slide 12 is guided in the slide guide means 5 in U-shaped profiled beams by way of rollers 6 mounted at the slide 12. A holder 9 is suspended from the profiled beam 4 and guided along the beam via rollers, hold-downs 10 being pivotably attached to this holder. The hold-downs downs 10 are stressed by pressure medium motors 11 with respect to the bole 8 so that the latter is fixedly urged against the slide 12. The bole is pressed against the slide 5 by the hold-downs 10 preferably so firmly that there need not be a clamping of the bole 8 on the end faces. The holder 9 is moved in synchronism with the slide 12, for example by way of a tackle.

In the embodiment of the invention illustrated in FIGS. 1 and 2, a support 13 is arranged at the slide 12 and is connected to the slide 12 at one of its ends 14, associated with the head end of the bole, by means of a joint 15. At its other end 16, the support 13 is connected to the slide 12 by way of an elevating means 17. The elevating device 17 consists of a bifurcate linkage 18 articulated, on the one hand, to the support 13 and to the slide 12 and connected, on the other hand, to a pressure medium motor 19 providing the lifting force. By this arrangement of the elevating means 17, only relatively small forces need to be supplied by the pressure medium motor 19 even in case of heavy logs. With the piston rod of the pressure medium cylinder 19 being fully extended, the support 13 rests with an extension 20 on the slide 12 and the support 13 is aligned in parallel to the slide 12, i.e. to the feeding direction of the slide 12.

The support 13 furthermore exhibits projecttions 21 studded with teeth on the side of the support facing the bole in order to prevent slipping of the bole off the support 13.

FIG. 3 illustrates a further embodiment of the elevating means according to this invention. Three cams 23', 23'', 23''' are mounted by way of axles 24 to the slide 12 which latter has a bearing 22 at its end facing the head end of the bole. The cams 23, the topside of which is toothed, are joined by way of a linkage 25 engaging at levers 27', 27'' and 27''' of the cams 23', 23'', 23''' and are driven by a pressure medium motor 26. The levers 27 exhibit differing lengths so that the cam 23' remotest from the bearing 22 projects farthest beyond the slide 12, and the height of the cams 23'' and 23''' above the slide 12 diminishes continuously toward the bearing 22 so that they form a planar support for the bole.

It would, of course, likewise be possible to provide that, rather than having the levers 27 of varying lengths, the parts 25' and 25'' of the linkage 25, connecting the individual levers 27 with one another, exhibit differing lengths, or that the contour of the cams is designed so that the zones of the cams 23 and of the bearing 22 on which the bole rests lie on a straight line in any position of the cams, in order to prevent bending of the bole.

As can be seen from FIGS. 1 and 4, the slide 12 is guided through in between forks 30 consisting each of two separate tines 31 equipped with revolving chains 32 with entraining members. These forks 30 are vertically adjustable by way of pressure medium motors.

The chains 32 are preferably driven via hydraulic motors wherein each fork branch 31 has its own drive. The support 13 for the bole is disposed between the tines 31.

With the aid of the revolving chains 32, the inserted bole is rotated into its most favorable position. Once this has been reached, the hold-downs 10 are lowered and, at the same time, the forks 30 are jointly lowered to such an extent that the bole 8 is in free contact with the support 13.

The facility operates as follows:

A bole is fed via chain conveyors laterally toward the slide 12 and inserted in the forks 30. The bole, thus inserted or lying in the waiting station, is measured at the tail and head ends by means of light barriers, half the diameter difference is calculated by means of a computer, and the support 13 or the cams 23 are lifted and, respectively, rotated to such an extent that the heart zone of the bole is oriented in parallel to the conveying direction.

At the same time, the forks 30 are lowered and the bole 8 pressed by means of the hold-downs 10 against the support 13 or the cams 23 and, respectively, the bearing 22. In the first passage, the barrels (rounded portions) are then cut off on both sides and, in the same operating cycle, the sapwood splints are cut off by the preceding rotary milling cutters, for the board to be severed during the subsequent operating cycle. However, preferably, the lateral barrels are sawed in a separate run so that edging and cutting off of the boards take place jointly. After each operating cycle, the slide is returned. As needed, boards or beams are sawed down to the clamping width, i.e. approximately to the width of the support 13 and, respectively, the slide 12. The remainder of the bole, clamped in place, is then rotated with the aid of the chains 32 mounted to the fork branches 31 by 90° and, with a simultaneous lowering of the support 13 and/or of the cams 23 and the forks 30, is clamped against the support 13 and/or the cams 23. At this point, the remaining rounded portions are cut off, and the remainder is processed into narrow boards or into beams. It is understood that the production of boards and beams can be performed as desired. Only the portion last clamped in place must perforce be made into a beam.

If presorted logs of varying diameters but uniform length are to be processed, then the lifting of the tail end of the bole 8 can be performed with the aid of empirical values (for example, for firs and spruces 1 cm/1 running meter). With these values, the lifting device can be fixedly set.

A further possibility resides in optical detection and thus-derived estimation by the operator. For aiding this procedure, well-readable scales can be mounted to vertical bars at the head and tail ends, these scales exhibiting an equal-spaced graduation. A manually operated push-button control of the lifting device facilitates the adjusting process.

The thus-separated boards and beams are discharged laterally beside the saw. A roof-shaped shell 33 (FIG. 5) laterally bordering the support and, respectively, the cams at the slide facilitates the sliding of the boards, beams, etc., onto a chain conveyor 34 disposed therebelow. As shown schematically in FIG. 5, the chain conveyor 34 can be displaceably retained in guides or rocker arms and can be reversible in its conveying direction so that the boards, etc., can be deposited selectively toward the right or the left.

What is claimed is:

1. In combination with a machining tool for machining boles, a clamping and feeding device for feeding the boles to the machining tool, said clamping and feeding device comprising a slide that carries the bole during machining, said slide having mounted thereon a pivotable device that directly supports the bole, said pivotable device being elongated and extending lengthwise of the bole and being pivotally connected at one end to the slide, and power means for changing the elevation of the other end of the elongated pivotable device thereby to permit positioning the bole with its heart zone parallel to the direction of movement of said slide.

2. Clamping and feeding device as claimed in claim 1, wherein said pivotable device has projections thereon studded with teeth that engage the bole.

3. Clamping and feeding device as claimed in claim 1, and hold-down means engaging the upper surface of the bole to press the bole against said pivotable device.

4. Clamping and feeding device as claimed in claim 3, said hold-down being plural and being supported on a common holder and being pressed against the bole by pressure medium motors.

5. Clamping and feeding device as claimed in claim 4, wherein said holder is guided on rollers in a profiled supporting beam.

6. In combination with a machining tool for machining boles, a clamping and feeding device for feeding the boles to the machining tool, said clamping and feeding device comprising a slide that carries the bole during machining, and lifting means carried by said slide for lifting one end of the bole relative to the other end of the bole, said lifting means comprising at least one cam supported eccentrically on the slide, and power means to rotate said at least one cam to lift said one end of the bole.

7. Clamping and feeding device as claimed in claim 6, there being at least two said cams spaced apart lengthwise of the bole and both mounted eccentrically on the slide, and bearing means for supporting the other end of the bole on the slide, said bearing means and said cam having bole-contacting surfaces that in any position of the cams are disposed in a straight line.

8. Clamping and feeding device as claimed in claim 7, further comprising linkage interconnecting the cams, and motor means for driving the linkage thereby simultaneously to move the cams.

9. Clamping and feeding device as claimed in claim 6, in which said at least one cam has bole-engaging teeth on an upper surface thereof.

* * * * *